US008607994B1

(12) United States Patent
Schneider

(10) Patent No.: US 8,607,994 B1
(45) **Date of Patent: *Dec. 17, 2013**

(54) BOTTLE DISPLAY APPARATUS

(75) Inventor: Thomas Schneider, Palo Alto, CA (US)

(73) Assignee: Vinotheque Wine Cellars, Stockton, CA (US)

( * ) Notice: Subject to any disclaimer, the term of this patent is extended or adjusted under 35 U.S.C. 154(b) by 151 days.

This patent is subject to a terminal disclaimer.

(21) Appl. No.: 13/107,718

(22) Filed: May 13, 2011

(51) Int. Cl.
*A47F 5/01* (2006.01)
*A47F 5/08* (2006.01)
*A47B 73/00* (2006.01)

(52) U.S. Cl.
USPC ..... 211/75; 211/59.1; 211/106; 211/106.01; 211/196

(58) Field of Classification Search
USPC ..... 211/75, 74, 181.1, 106, 106.1, 59.1, 211/70.6, 196, 205, 107, 166, 133.4, 59.2; D7/601, 602, 701, 704, 708.1, 619.1, D7/620, 624.1; D8/363, 370, 373; D6/449, D6/462, 463, 566; 248/220.31, 220.41, 248/249, 153, 218.1, 230.1, 302, 304, 312
See application file for complete search history.

(56) References Cited

U.S. PATENT DOCUMENTS 1,751,505 A * 3/1930 Borland, Jr. ..... 211/163
2,636,704 A * 4/1953 Norberg ..... 248/79
3,153,526 A * 10/1964 Pawsey ..... 248/219.1
3,200,960 A * 8/1965 Banse ..... 206/459.5
D225,509 S * 12/1972 Charlton ..... D8/363
3,901,389 A * 8/1975 Belokin, Jr. ..... 211/74
D247,532 S * 3/1978 Tenney ..... D6/465
4,106,736 A * 8/1978 Becker et al. ..... 248/222.51
D255,324 S * 6/1980 Pierce ..... D8/380
D288,038 S * 2/1987 Henning ..... D6/458
4,694,966 A * 9/1987 Sorenson et al. ..... 211/88.01
4,723,663 A * 2/1988 Learn ..... 211/59.2
4,724,967 A * 2/1988 Valiulis ..... 211/59.1
4,863,131 A * 9/1989 Kinseley ..... 248/220.41
D307,220 S * 4/1990 Kaufman, Jr. ..... D6/462
D315,670 S * 3/1991 Shirley ..... D8/373
5,014,949 A * 5/1991 Niven ..... 248/220.41
D338,700 S * 8/1993 Webb ..... D21/786
D345,298 S * 3/1994 Rosenthal ..... D8/373
5,388,709 A * 2/1995 Adams ..... 211/70.6
D356,916 S * 4/1995 Chadwick ..... D6/566
5,597,150 A * 1/1997 Stein et al. ..... 248/551
D378,881 S * 4/1997 Lusk et al. ..... D6/463
D386,363 S * 11/1997 Dardashti ..... D7/704
5,826,731 A * 10/1998 Dardashti ..... 211/74
5,865,326 A * 2/1999 Spamer et al. ..... 211/181.1
5,996,955 A * 12/1999 Chen ..... 248/302
D434,619 S * 12/2000 Janis ..... D7/702
6,173,845 B1 * 1/2001 Higgins et al. ..... 211/74
D461,372 S * 8/2002 Geatti ..... D7/620
D462,200 S * 9/2002 Pollard et al. ..... D6/458
6,612,448 B2 * 9/2003 Plutsky ..... 211/43

(Continued)

*Primary Examiner* — Jennifer E Novosad
(74) *Attorney, Agent, or Firm* — Hickman Palermo Truong Becker Bingham Wong LLP

(57) ABSTRACT

In an embodiment, a bottle holder apparatus comprises an elongated element comprising a first end joined to a first arcuate neck retaining portion, a first arm joined to the first arcuate neck retaining portion and to an arcuate loop, a second arm parallel to the first arm and joining the arcuate loop to a second arcuate neck retaining portion that is aligned with the first arcuate neck retaining portion, and a second end joined to the second arcuate neck retaining portion.

30 Claims, 11 Drawing Sheets

(56) References Cited

U.S. PATENT DOCUMENTS

| | | | | |
|---|---|---|---|---|
| D483,655 | S * | 12/2003 | Dretzka | D8/367 |
| 6,991,117 | B2 | 1/2006 | McCain | |
| D529,859 | S * | 10/2006 | Irvine | D12/411 |
| D555,462 | S * | 11/2007 | Moffitt et al. | D8/370 |
| 7,322,482 | B2 * | 1/2008 | Caradonna | 211/74 |
| 7,334,853 | B2 * | 2/2008 | Ahmed et al. | 312/405.1 |
| 7,882,964 | B2 * | 2/2011 | Battaglia | 211/59.1 |
| D655,986 | S * | 3/2012 | Schneider | D7/620 |
| D669,767 | S * | 10/2012 | Burley | D8/370 |
| 2002/0043509 | A1 * | 4/2002 | Lajeunesse et al. | 211/59.2 |
| 2006/0043035 | A1 * | 3/2006 | Madsen | 211/74 |
| 2006/0163181 | A1 * | 7/2006 | Caradonna | 211/74 |
| 2009/0032482 | A1 * | 2/2009 | Battaglia | 211/59.1 |
| 2009/0152221 | A1 | 6/2009 | Hynes | |
| 2009/0152223 | A1 | 6/2009 | McCain | |
| 2011/0132853 | A1 * | 6/2011 | Drobot et al. | 211/42 |

* cited by examiner

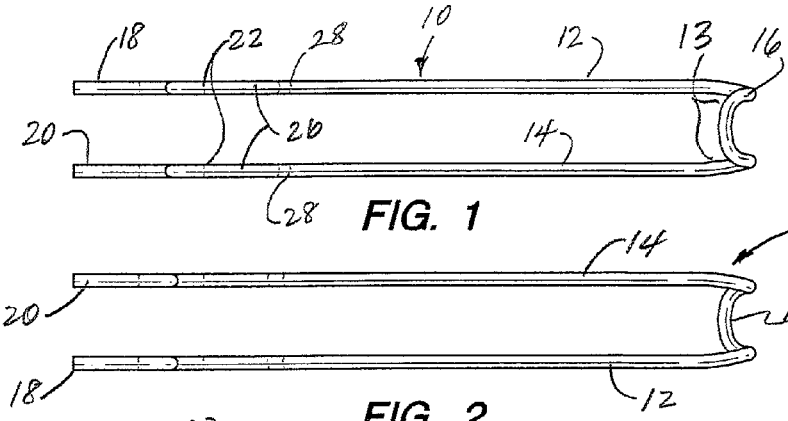
FIG. 1
FIG. 2
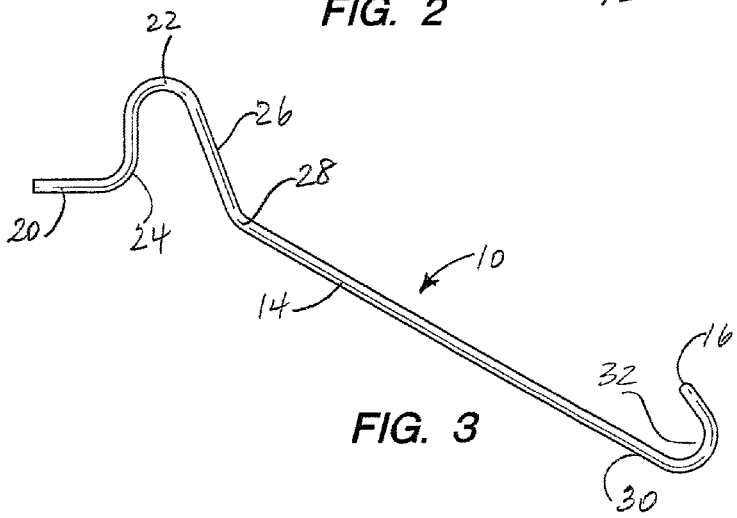
FIG. 3
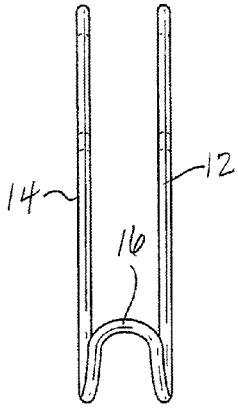
FIG. 4
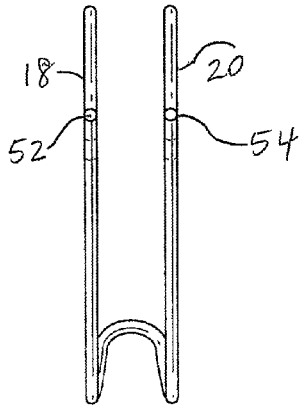
FIG. 5

BOTTLE DISPLAY APPARATUS

TECHNICAL FIELD

The present disclosure generally relates to apparatus for holding bottles and similar articles. The disclosure relates more particularly to bottle display apparatus such as wine racks.

BACKGROUND

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

Owners of bottles of valuable wine, other beverages, and certain vinegars, oils or other consumables often display the bottles using racks, cabinets, refrigeration units, shelves, boxes, or other furnishings or display equipment. Typically the bottles are stored horizontally in a position in which only the end or neck of the bottle is visible to the observer. If the side of the bottle is visible, typically the side is oriented horizontally so that to view or read a label on the bottle, the observer is required to remove the bottle from the storage location or turn the head sideways in an uncomfortable position. Certain shelving systems can display bottles in a forward-facing orientation, but the shelving is typically bulky, expensive, or obscures lower rows of bottles when used in multiple rows. There is a need in the art for an improved way to display bottles, especially bottles of wine or other valuable beverages, which overcomes the foregoing disadvantages of the state of the art.

SUMMARY OF THE INVENTION

The invention is summarized in the appended claims.

BRIEF DESCRIPTION OF DRAWINGS

FIG. 1 is a top plan view of a bottle holder.

FIG. 2 is a bottom plan view of the bottle holder of FIG. 1.

FIG. 3 is a side elevation view of the bottle holder of FIG. 1.

FIG. 4 is a first end elevation view of the bottle holder of FIG. 1.

FIG. 5 is a second end elevation view of the bottle holder of FIG. 1.

Figure 6:
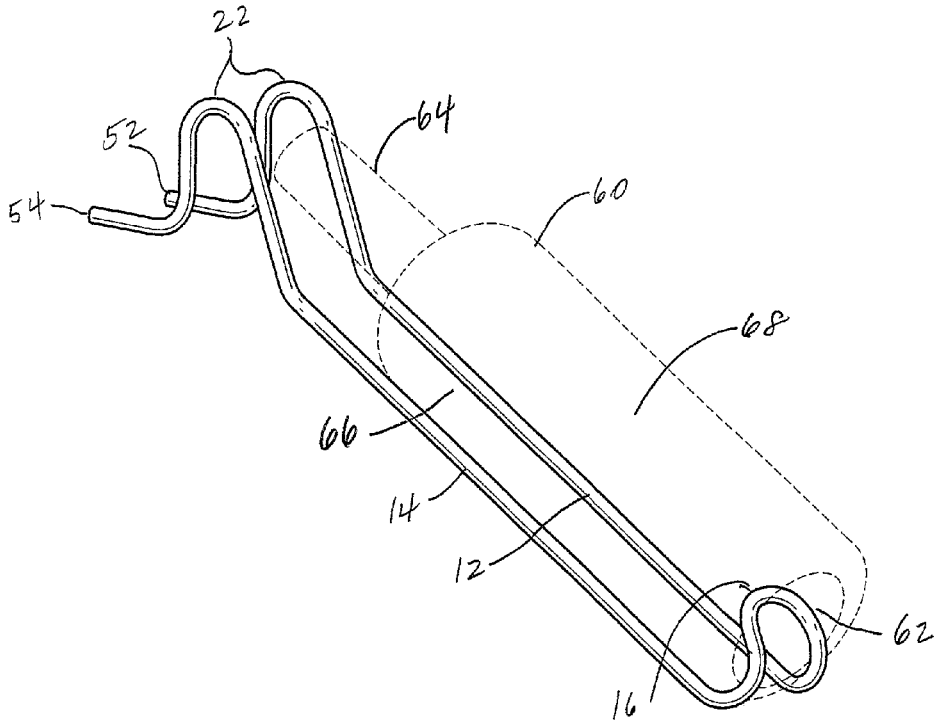
FIG. 6 is a perspective view of the bottle holder of FIG. 1 with a bottle shown in phantom outline.

The drawings are not rendered to scale.

DETAILED DESCRIPTION OF DRAWINGS

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

GENERAL OVERVIEW

In an embodiment, bottle holding apparatus comprises an elongated element comprising a first end joined to a first arcuate neck retaining portion, a first arm joined to the first arcuate neck retaining portion and to an arcuate loop, a second arm parallel to the first arm and joining the arcuate loop to a second arcuate neck retaining portion that is aligned with the first arcuate neck retaining portion, and a second end joined to the second arcuate neck retaining portion.

In an embodiment, the apparatus further comprises a first arc portion joining the first end to the first arcuate neck retaining portion and a second arc portion joining the second end to the second arcuate neck retaining portion.

In an embodiment, the first arm is spaced apart from the second arm by less than a body width of a wine bottle. In an embodiment, the arcuate loop has a lateral width that is less than a punt of a wine bottle. In an embodiment, the elongated element is a rod having a round cross section. In an embodiment, the elongated element is a steel rod.

In an embodiment, the apparatus has a length to enable a punt of a bottle to rest on the arcuate loop and a neck of the same bottle to rest between the first arcuate neck retaining portion and the second arcuate neck retaining portion when the same bottle is on the apparatus. In an embodiment, the bottle is a 750 ml wine bottle.

In an embodiment, the elongated element comprises a contiguous rod in which all of the first end, the first arcuate neck retaining portion, the first arm, the arcuate loop, the second arm, the second arcuate neck retaining portion, and the second end are integrally formed.

In an embodiment, a bottle rack apparatus comprises an upright support element comprising one or more pairs of holes having horizontal axes; one or more units of a bottle holder apparatus, wherein each of the units is mountable to a particular pair of the holes; and each of the units of the bottle holder apparatus comprises an elongated element comprising a first end joined to a first arcuate neck retaining portion, a first arm joined to the first arcuate neck retaining portion and to an arcuate loop, a second arm parallel to the first arm and joining the arcuate loop to a second arcuate neck retaining portion that is aligned with the first arcuate neck retaining portion, and a second end joined to the second arcuate neck retaining portion.

In various embodiments, the bottle rack apparatus may comprise any of the features identified above for a bottle holder apparatus.

In an embodiment, the support element comprises any of a post, a column, and a wall. In an embodiment, the bottle rack apparatus has a plurality of first rows of first units of the bottle holder apparatus and a plurality of second rows of second units of the bottle holder apparatus, wherein the first units are in a staggered alignment with respect to the second units.

In an embodiment, the bottle rack apparatus comprises a plurality of first rows of first units of the bottle holder apparatus and a plurality of second rows of second units of the bottle holder apparatus, wherein the first units are vertically aligned with the second units.

In an embodiment, the support element is vertical. In an embodiment, the support element comprises a wall joined at an acute angle to a floor. In an embodiment, the support element comprises a vertical post having a plurality of first style faces and a plurality of second style faces, and wherein the first style faces comprise a first plurality of pairs of holes that is different in number than a second plurality of pairs of holes in the second style faces.

In an embodiment, the support element comprises a vertical post having a plurality of first style faces and a plurality of second style faces, and wherein the first style faces comprise a first plurality of units of the bottle holder apparatus that is different in number than a second plurality of units of the bottle holder apparatus in the second style faces.

In an embodiment, the support element comprises a vertical post having a round cross section, and wherein the first style faces comprise a first plurality of units of the bottle holder apparatus that is different in number than a second plurality of units of the bottle holder apparatus in the second style faces.

Example Embodiments

FIG. 1 is a top plan view of a bottle holder. FIG. 2 is a bottom plan view of the bottle holder of FIG. 1. FIG. 3 is a side elevation view of the bottle holder of FIG. 1. FIG. 4 is a first end elevation view of the bottle holder of FIG. 1. FIG. 5 is a second end elevation view of the bottle holder of FIG. 1. FIG. 6 is a perspective view of the bottle holder of FIG. 1 with a bottle shown in phantom outline. For purposes of illustrating a clear example, FIG. 1 through FIG. 6, inclusive, are described together.

In an embodiment, a bottle holder 10 comprises an elongated element that is curved and formed in certain arcs and angles as seen in FIG. 1, for example. Example embodiments may comprise tubing, rods, or bars of steel, resins, plastic, bentwood, ceramics, composites, or any other material having suitable tensile and compressive strength to hold a bottle in the positions that are shown in this disclosure.

In an embodiment, bottle holder 10 may comprise integrally formed side arms 12, 14 that are joined at first terminal ends 13 by an integrally formed retaining arc 16. The terminal ends 13 may be inwardly angled so that a lateral width of the retaining arc 16, perpendicular to the elongated dimensions of side arms 12, 14, is less than a lateral separation or distance between the side arms. Side arms 12, 14 may transition using curved neck retaining portions 22 to respective second ends 18, 20. The side arms 12, 14 may have length dimensions that generally correspond to a length or height of a body portion of a bottle to be retained in the apparatus.

For purposes of explaining angular relationships of elements of the bottle holder 10, the second ends 18, 20 will be denoted as aligned in a horizontal plane as best seen in FIG. 3. From this perspective, curved portions 22 are joined to ends 18, 20 by curve transition elements 24 that generally define a right angle but feature a smoothly curved perimeter.

Curved portions 22 may define approximately half circles and may be further joined to arms 12, 14 by a downwardly extending angled section 26 at an obtuse angle with respect to the horizontal plane. That is, the angled section 26 is not aligned in a true vertical orientation but is angled slightly off the vertical plane. The angled sections 26 are joined to arms 12, 14 by an obtuse angle 28. Angled sections 26 may have length dimensions that are selected as suitable for particular bottles to be retained in the apparatus and, as seen in other views, are typically formed having lengths sufficient to cause the curved neck retaining portions 22 to lie adjacent to a neck portion of a bottle when the bottle is positioned in the apparatus.

The retaining arc 16 is also angled in a position such that as seen in FIG. 3 the retaining arc is not exactly parallel to a lower end of the arms 12, 14 but instead forms a slightly opened arcuate transition 32 to the arms. As seen from FIG. 4, which is a first end elevation view of the bottle holder of FIG. 1 viewed from what may be termed a front position, the retaining arc 16 extends upwardly and in this position may engage a bottom of a bottle as further seen in other views.

As seen from FIG. 5, which is a second end elevation view of the bottle holder of FIG. 1 viewed from what may be termed a rear position, ends 18, 20 of arms 12, 14 terminate respectively in tips 52, 54 which have a circular cross-section when the arms 12, 14 are formed of a rod or tube material. Tips 52, 54 may snugly engage corresponding holes in a generally vertical mounting structure and thereby retain the bottle holder 10 in a protruding, cantilevered position in which the tips 52, 54 are the only means of engagement with a supporting structure and bear all weight of the bottle. The corresponding holes may have any suitable depth to receive portions of ends 18, 20. Example mounting structures are shown in other views of this disclosure, and examples may include a wall, cabinet, rack, bar, column, or any other structure capable of bearing the weight of bottles.

FIG. 6 is a perspective view of the bottle holder of FIG. 1 with a bottle shown in phantom outline. An example bottle 60 comprises a domed base indentation, kick-up or punt 62, neck 64, and body 66 having a label region 68. In an embodiment, when apparatus 10 is in use, the punt 62 of bottle 60 rests by gravity against retaining arc 16, and body 66 rests against the side arms 12, 14, effectively providing a highly stable three-point means of support. Although not strictly necessary for stability, in an embodiment, neck 64 is positioned between the curved neck retaining portions 22, improving stability by preventing the neck from moving laterally in an excess amount.

In an embodiment, when ends 52, 54 of arms 12, 14 are engaged in corresponding holes of vertical mounting elements, the label region 68 of bottle 60 may be displayed outward and at an angle toward a viewer to facilitate reading and to provide an aesthetically attractive manner of presenting the bottle to the viewer. In particular, embodiments provide means of displaying bottles in a forward-facing or forward-thrusting manner so that the viewer is not required to turn the head or neck sideways to read the label of the bottle, as in prior apparatus; further, the viewer is not required to remove the bottle completely from the apparatus, as with end-loading racks.

One or more units of apparatus 10 having the arrangement shown in FIG. 1 to FIG. 6, inclusive may be incorporated into bottle racks, bottle displays, and bottle display systems having various arrangements, features and functions. The racks, displays and systems may be incorporated into furnishings such as restaurant host stands, credenzas, server stations, wall displays, or other multiple-purpose furniture or fixtures. One or more units of apparatus 10 may be affixed to columns, bars, channels, standards, tubes, panels, walls, and any other structural support that is stable in a generally upright or vertical orientation. For example, apparatus 10 may be affixed to a channel or standard made of steel or other metal and having a plurality of spaced-apart pairs of holes that may snugly receive ends 52, 54; in this arrangement, one or more of the channels or standards may be affixed to a solid surface such as a wall, post or furnishing and multiple units of the apparatus 10 may be mounted to the holes in the channels or standards.

For purposes of illustrating clear examples, FIG. 7 to FIG. 15, inclusive, illustrate particular bottle racks, bottle displays, and bottle display systems. However, apparatus 10 may be used in many other forms of racking, displays and systems and the use of the apparatus is not limited to the particular examples shown in FIG. 7 to FIG. 15 and/or described herein.

Figure 7:
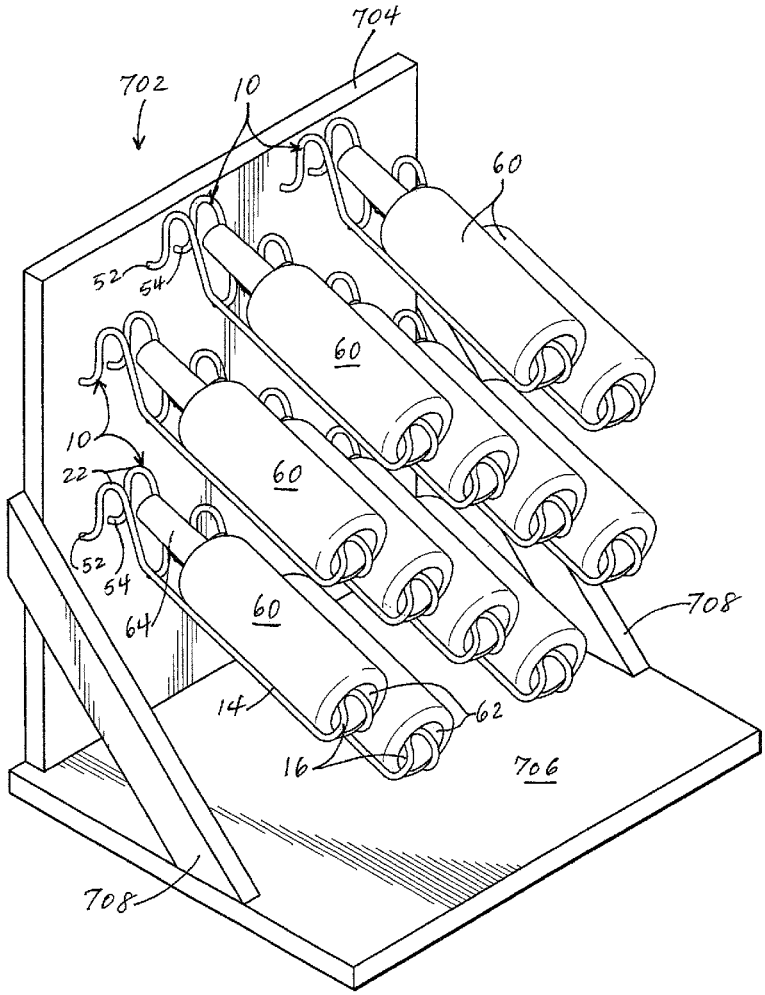
FIG. 7 illustrates an example bottle rack using the apparatus as described herein.

FIG. 7 illustrates an example bottle rack using the apparatus as described previously herein. In an embodiment, bottle rack 702 comprises a vertically oriented wall 704 and horizontally oriented floor 706 secured by braces 708. Twelve (12) identical units of bottle holder apparatus 10 are mounted solely by ends 52, 54 in corresponding holes in wall 704. Thus, each unit of the apparatus 10 extends outwardly from wall 704 in a cantilevered manner with ends 52, 54 acting as sole means of support and attachment to the wall. Up to twelve (12) bottles 60 may be mounted in the rack 702 with one bottle mounted on each unit of the apparatus 10 in the same manner described for FIG. 6. In this arrangement, up to an entire case of wine, for example, may be displayed in a manner that presents the labels of the wine bottles directly to a viewpoint of a viewer who is facing the wall 704. Each bottle appears in a sense to be floating in the rack and there is no need to remove the bottle from the rack to view or read the details of the labels. An individual bottle is easily removed by urging the body of the bottle upwardly to release punt 62 from the retaining arc 16 while lifting the neck slightly to clear the curved neck retaining portions 22 of apparatus 10.

Figure 8:
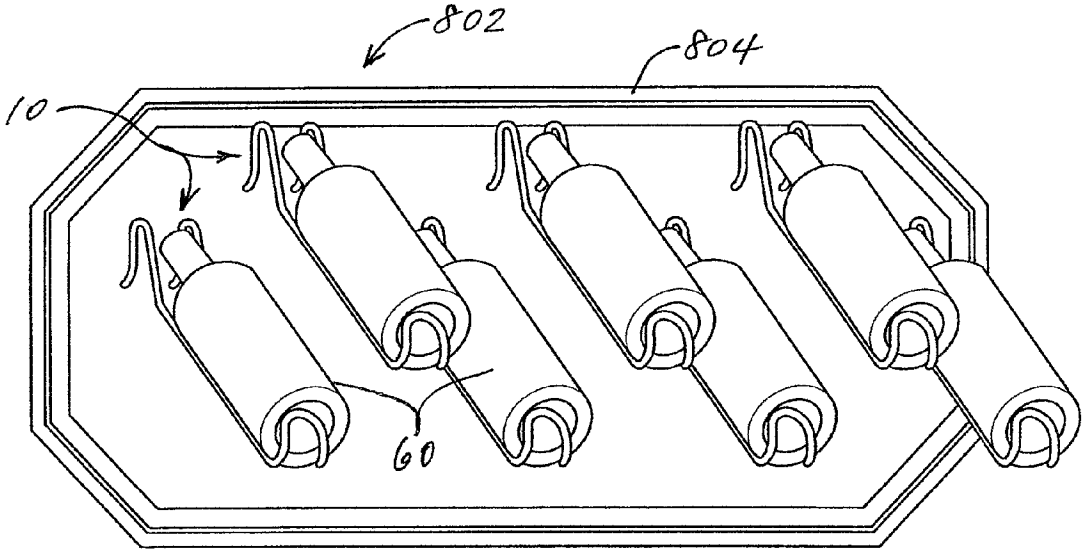
FIG. 8 illustrates another example bottle rack.

FIG. 8 illustrates another example bottle rack. In the example of FIG. 8, a bottle rack 802 comprises a generally vertical, planar wall 804 in the style of a carved plaque and comprises seven (7) units of bottle holder apparatus 10. Units of apparatus 10 may be mounted in wall 804 by friction fit of ends 52, 54 into corresponding holes in the wall providing for a snug fit. Additionally or alternatively, ends 52, 54 may comprise external threads, for example, to which corresponding nuts are attached to retain the apparatus 10 tightly against wall 804. Additionally or alternatively, apparatus 10 may be retained in holes in wall 804 using adhesives, for example, epoxy resins, construction adhesives, or any other adhesive that is appropriate for the materials from which the apparatus and the wall are made.

For purposes of illustrating a clear example, FIG. 8 shows two (2) rows of units of apparatus 10 and a total of seven (7) units. In other embodiments, the arrangement of FIG. 8 may be used with any number of rows of units and any total number of units. In an embodiment, the units are arranged in two or more rows, and units in a first row are staggered or offset with respect to units of a second row such that units of the rows are not in vertical alignment. Such a staggered or offset arrangement facilitates viewing labels of bottles by ensuring that bottles of upper rows do not obscure bottles of lower rows when viewed from the front or from slightly above the rack 802.

Figure 9:
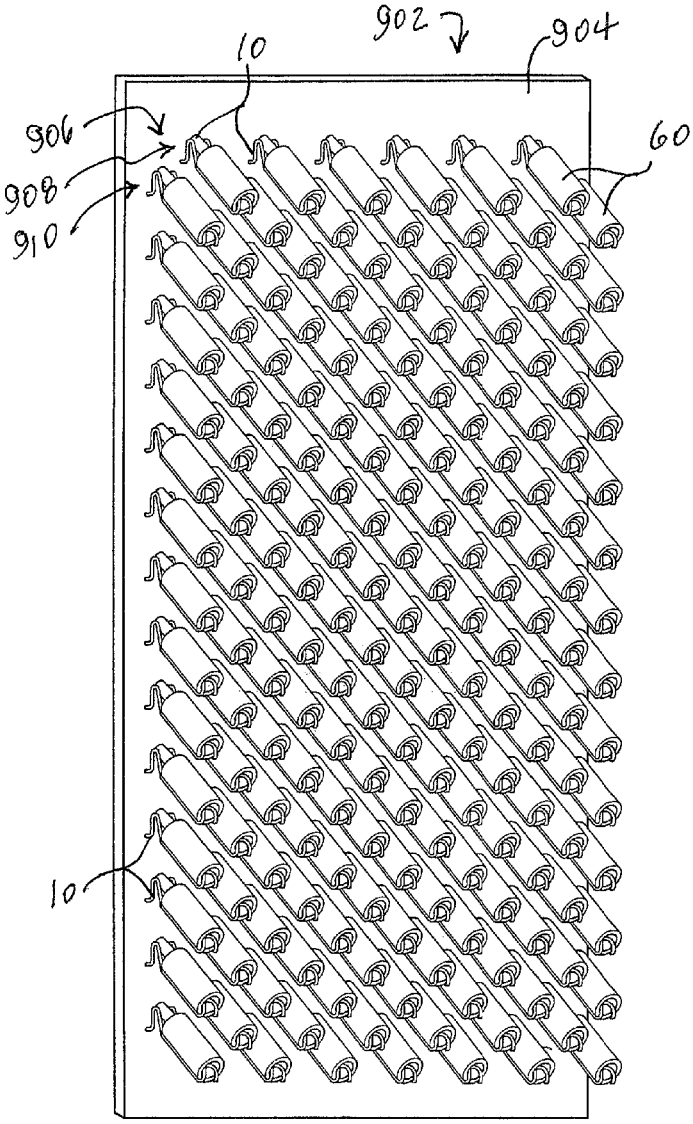
FIG. 9 illustrates still another example bottle rack.

FIG. 9 illustrates still another example bottle rack. In the example of FIG. 9, a bottle rack 902 comprises a generally vertical, planar wall 904 in which 182 units of bottle holder apparatus 10 are mounted, arranged in 14 rows of seven (7) units of apparatus 10 alternating with 14 rows of six (6) units of the apparatus. In other embodiments, the arrangement of FIG. 8 may be used with any number of rows of units and any total number of units. In an embodiment, the units are arranged in pairs of two, and units in a first row of the pair of rows are staggered or offset with respect to units of a second row of the pair of rows, such that units of the rows are not in vertical alignment. Such a staggered or offset arrangement facilitates viewing labels of bottles by ensuring that bottles of upper rows do not obscure bottles of lower rows when viewed from the front or from slightly above the rack 902. The arrangement of FIG. 9 could be used, for example, for a wall-height bottle storage system or display system in which wall 904 has an overall height approximately equivalent to the height of a wall of a room, wine cellar, or other display location. Units of apparatus 10 may be mounted to wall 904 using any of the means for affixing that are described above with reference to FIG. 8.

Figure 10:
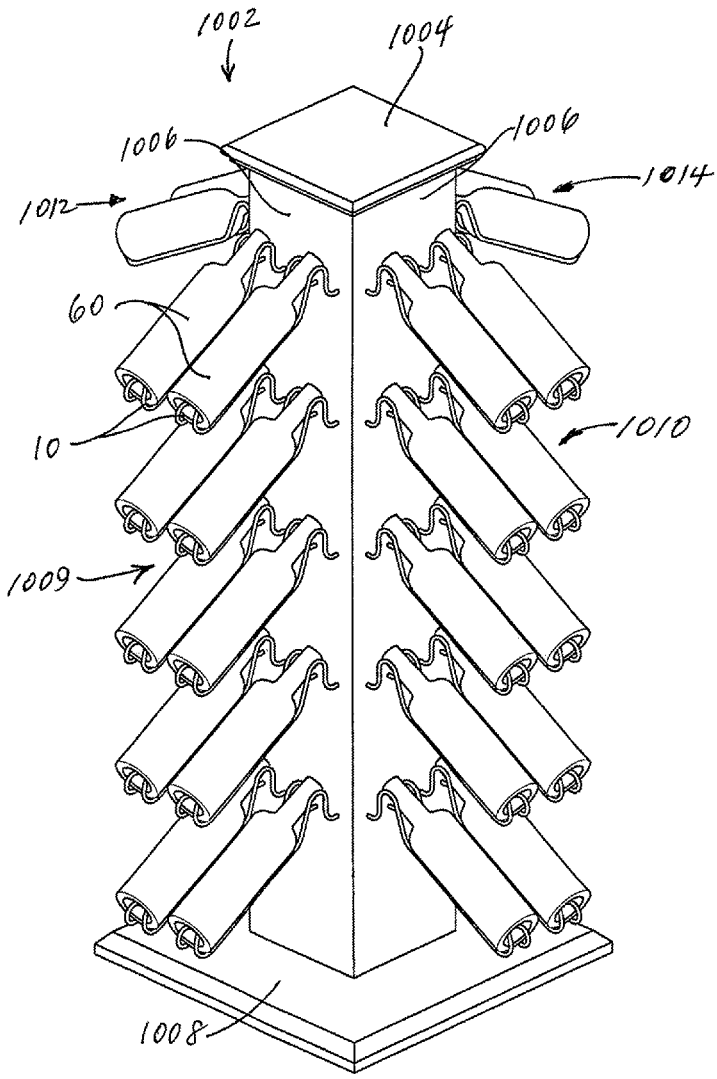
FIG. 10 illustrates a first example columnar bottle display system.

FIG. 10 illustrates a first example columnar bottle display system. In an embodiment, a bottle display system 1002 comprises a post or column 1004 comprising one or more faces 1006 and optionally secured to a base 1008. In an embodiment, column 1004 is square or rectangular in cross section and has four (4) faces 1006; in alternatives, the column may be round and have a single continuous face or may have a cross section forming a triangle, hexagon or other polygon. In an embodiment, column 1004 may be affixed to base 1008 using means for rotation of the column with respect to the base, such as a pin riding in a bearing, a set of ball bearings, etc.

In an embodiment, a plurality of sets 1009, 1010, 1012, 1014 of units of apparatus 10 are secured to different ones of the faces 1006 and each of the sets corresponds to one of the faces. In the example embodiment of FIG. 10, each of the sets 1009, 1010, 1012, 1014 comprises five (5) pairs of units of apparatus 10, and each pair is vertically aligned with other pairs in the same set. Thus, each face 1006 displays ten (10) bottles arranged in five rows of two bottles each.

In other embodiments, column 1004 may have any desired height and there may be any number of rows of bottles. Further, column 1004 may have any desired width and there may be any number of bottles in a particular row. Units of apparatus 10 may be mounted to column 1004 using any of the means for affixing that are described above with reference to FIG. 8.

Figure 11:
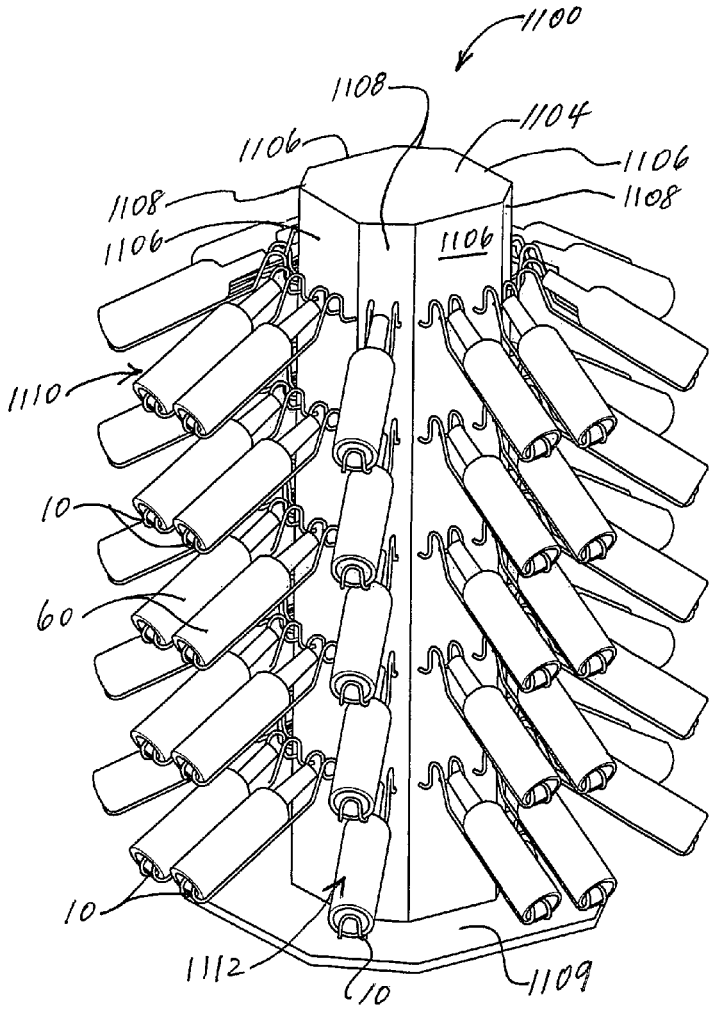
FIG. 11 illustrates a second example columnar bottle display system.

FIG. 11 illustrates a second example columnar bottle display system. In an embodiment, a bottle display system 1100 comprises a post or column 1104 comprising one or more first style faces 1106 and second style faces 1008, and optionally secured to a base 1109. In an embodiment, column 1104 is octagonal in cross section and has four (4) first style faces 1106 in alternating arrangement with four (4) second style faces 1008; in alternatives, the column may be round and have a single continuous face or may have a cross section forming a hexagon or other polygon having an even number of faces. In an embodiment, column 1104 may be affixed to base 1109 using means for rotation of the column with respect to the base, such as a pin riding in a bearing, a set of ball bearings, etc.

In an embodiment, a plurality of first style sets 1110 and a plurality of second style sets 1112 of units of apparatus 10 are secured respectively to different ones of the first style faces 1106 and second style faces 1108, and each of the sets corresponds to one of the faces. In the example embodiment of FIG. 11, each of the first style sets 1110 is on one of the first style faces 1106 and comprises five (5) pairs of units of apparatus 10, and each pair is vertically aligned with other pairs in the same set. Thus, each of the first style faces 1106 displays ten (10) bottles arranged in five rows of two bottles each. In the example embodiment of FIG. 11, each of the second style sets 1112 is on one of the second style faces 1108 and comprises five (5) single units of apparatus 10, and each unit is vertically aligned with other units in the same set. Thus, each of the second style faces 1108 displays five (5) bottles arranged in five rows of one bottle each. The total bottle capacity of the example of FIG. 11 is 60 bottles.

In other embodiments, column 1104 may have any desired height and there may be any number of rows of bottles in each of the styles of sets 1110, 1112. The first style faces 1106 and second style faces 1108 may have any desired width and there may be any number of bottles in a particular row. Units of apparatus 10 may be mounted to column 1104 using any of the means for affixing that are described above with reference to FIG. 8.

Figure 12:
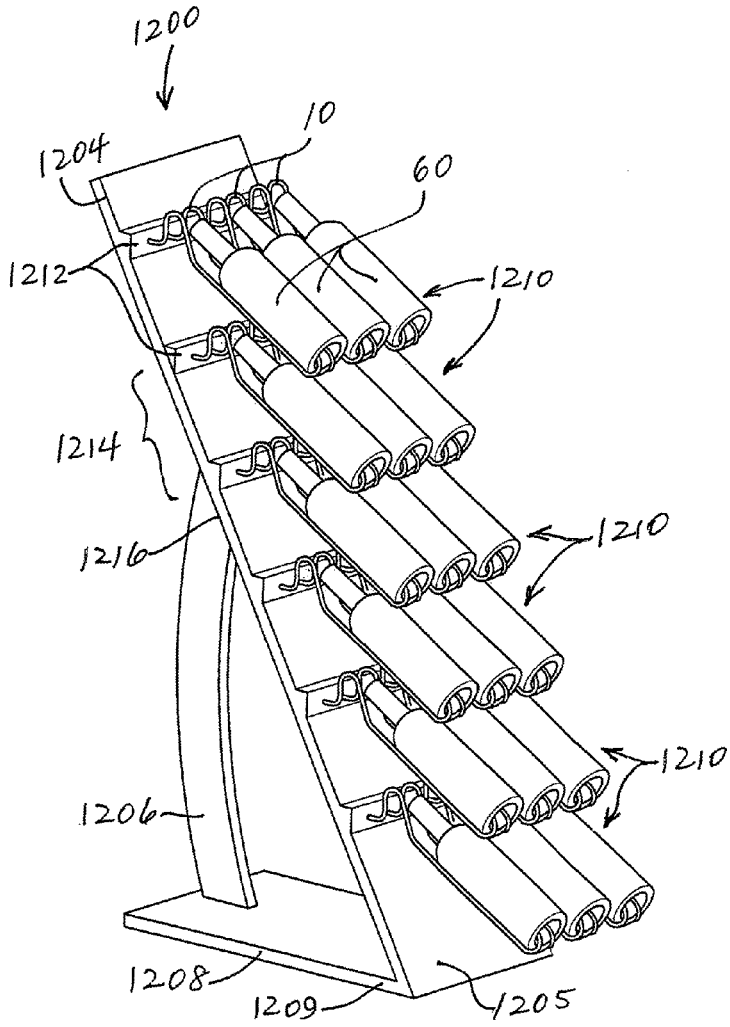
FIG. 12 illustrates yet another example bottle rack.

FIG. 12 illustrates yet another example bottle rack. In the example of FIG. 12, a bottle rack 1200 comprises an upright wall 1204 having a lower end 1205 that is secured to a first end 1209 of a floor 1208 and stabilized by a brace 1206 extending from an opposite end of the floor to an upper portion 1216 of a rear face of the upright wall. In this arrangement, brace 1206 is a load-bearing member of the rack that transfers weight or load from the upright wall 1204 to the floor 1208 when the rack 1200 is loaded with a plurality of bottles 60.

The wall 1204 comprises a plurality of spaced apart lateral cleats 1212 to which one or more units of apparatus 10 are affixed. For example, ends 52, 54 of units of apparatus 10 may snugly engage corresponding holes in the cleats 1212. Cleats 1212 may be spaced apart by a distance 1214 sufficient to enable labels of bottles 60 in successive rows to be visible when the rack 1200 is loaded with bottles; however, the specific value of the distance is not critical and any suitable distance may be used.

In an embodiment, the units of apparatus 10 are arranged in a plurality of rows 1210, and each of the rows 1210 is affixed to a particular one of the cleats 1212. In the example of FIG. 12, each of the rows 1210 comprises three (3) units of apparatus 10, and units of one particular row are generally vertically aligned, without staggering or offsetting, with respect to rows that are above or below. However, vertical alignment as seen in FIG. 12 is not required, and a staggered or offset arrangement may be used for successive rows. For purposes of illustrating a clear example, FIG. 12 shows six (6) rows 1210 and shows three (3) units of apparatus 10 per row for a total bottle capacity of 18. However, alternative embodiments may use any number of rows and many have any number of units per row. For example, rack 1200 could be arranged with four (4) rows of three (3) units each to display a single 12-bottle case of wine or other beverage, and any other geometry is within the scope of the disclosure.

In FIG. 12, again for purposes of illustrating a clear example, brace 1206 is illustrated in a curved arrangement, wall 1204 is illustrated as joining floor 1208 at an acute angle so that the wall tilts rearwardly, and lower end 1205 of the wall is joined to the floor at a front end 1209 of the floor. However, these construction details may be varied in alternative embodiments. For example, brace 1206 may be straight, or may incorporate decorative curvature or other aesthetic elements. Wall 1204 may be arranged vertically or substantially vertically, or may have a different angle with respect to floor 1208 than shown in FIG. 12. Lower end 1205 of wall 1204 may be joined to floor 1208 at or near the midpoint of the floor, or away from the end 1209 of the floor.

Figure 13:
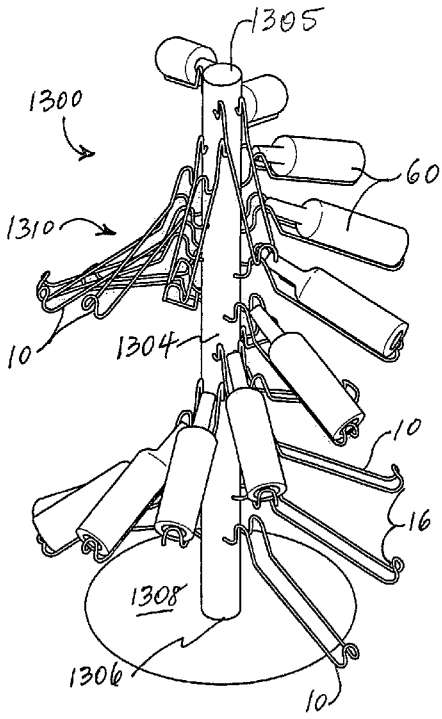
FIG. 13 is a perspective view of a columnar bottle display system having spirally arranged mounting apparatus.
Figure 14:
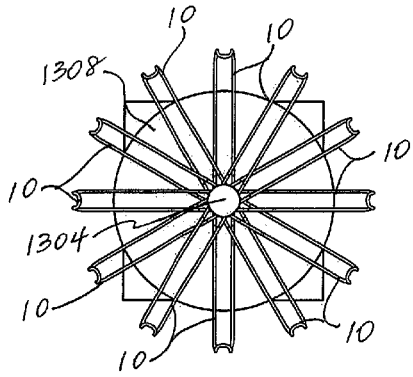
FIG. 14 is a top plan view of the columnar bottle display system of FIG. 13.
Figure 15:
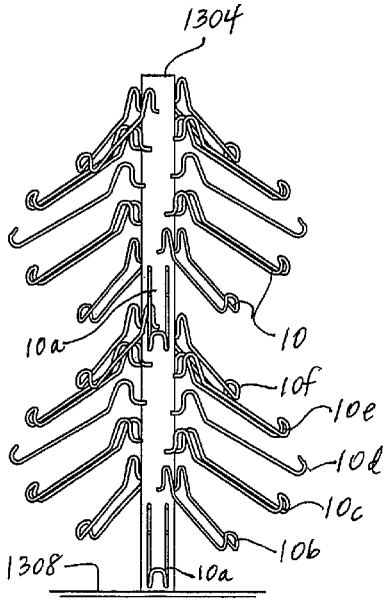
FIG. 15 is a side elevation view of the columnar bottle display system of FIG. 13.

FIG. 13 is a perspective view of a columnar bottle display system having spirally arranged mounting apparatus. FIG. 14 is a top plan view of the columnar bottle display system of FIG. 13. FIG. 15 is a side elevation view of the columnar bottle display system of FIG. 13. Referring first to FIG. 13, in an embodiment, a bottle display system 1300 may comprise a post 1304 having a generally circular cross section as seen at the top end 1305 of the post and having a lower end 1306 that is mounted to a floor 1308. In an embodiment, floor 1308 may be circular, but floors of any other perimeter dimensions or geometry may be used, and the post 1304 also may be joined or affixed directly to a floor of a room, building, other architectural feature or furnishing with which the system is used, so that a floor element particularly made just for the system 1300 is not required.

Further, in an embodiment the top end 1305 of the post and the lower end 1306 both may be affixed to surfaces of a room, building, other architectural feature, or furnishing; for example, the top end may be affixed to a ceiling and the lower end may be affixed to a floor. In an embodiment, post 1304 may incorporate aesthetic or architectural features such as grooves, ridges, or other surface ornamentation; for example, the post may be formed as an architectural column of any style such as Doric, Ionic or Corinthian.

In an embodiment, post 1304 comprises a single continuous face having a plurality of pairs of holes in the face. In an embodiment, successive pairs of holes are offset upwardly or downwardly around a circumference of the post 1304 so that the pairs of holes are arranged in a spiraling pattern around the post. As seen in FIG. 13, FIG. 14, each unit of a plurality of units of apparatus 10 is mounted in one of the pairs of holes. Referring now to FIG. 15, the units of apparatus 10 may comprise a first unit 10*a* mounted in a pair of holes in post 1304 at a lower most part of the post near the floor 1308, and successive units 10*b*, 10*c*, 10*d*, 10*e*, 10*f*, and others may be mounted to pairs of holes in successively higher locations. In one embodiment, twelve (12) units of apparatus 10 may completely encircle the post 1304, as best seen in FIG. 14, and there may be a plurality of sets of twelve (12) units mounted to a particular post so that multiple circles of sets surround, spiral or twist around the post.

In this arrangement, placing bottles 60 on some or all of the units 10 provides an attractive cantilevered display of bottles that spiral or twist around the post 1304, and for which label regions of all the bottles are readily visible to an observer.

Figure 16:
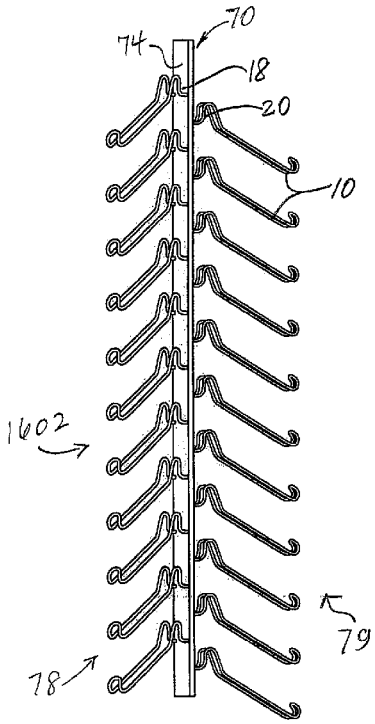
FIG. 16 is a perspective view of another example bottle rack.
Figure 17:
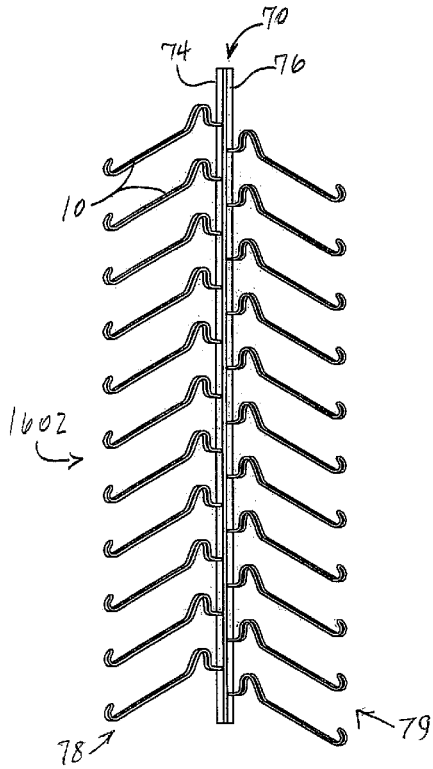
FIG. 17 is a front elevation view of the bottle rack of FIG. 16.
Figure 18:
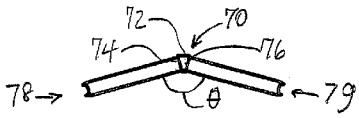
FIG. 18 is a top plan view of the bottle rack of FIG. 16.

FIG. 16 is a perspective view of another example bottle rack. FIG. 17 is a front elevation view of the bottle rack of FIG. 16. FIG. 18 is a top plan view of the bottle rack of FIG. 16. Referring first to FIG. 16, in an embodiment, a bottle rack 1602 comprises a plurality of units of apparatus 10 joined to or mounted in an elongated vertically oriented rail or channel 70 in a first set 78 and a second set 79. The units of apparatus 10 may be joined to or mounted in the channel 70 in positions that are spaced apart to permit clearance of bottles that are loaded onto the apparatus. Channel 70 may comprise a plurality of mounting holes spaced apart along the length of the channel and through which screws, bolts or other fasteners may extend for use in affixing the channel to a wall, rail, furnishing, or other stable unit or surface. For example, in one embodiment the channel 70 may have four (4) spaced apart holes and the channel may be affixed to wall studs or other stable units or surfaces using screws.

In an embodiment, as seen in FIG. 18, channel 70 has a generally triangular cross section comprising a rear wall 72 and side walls 74, 76. Each side wall 74, 76 may comprise a plurality of spaced apart pairs of holes configured to snugly engage or receive ends 52, 54 of apparatus 10. As seen in front elevation FIG. 17, this arrangement enables the units of apparatus 10 to project outwardly nearly planar to a wall on which the channel 70 is mounted, so that bottles resting in apparatus 10 are readily perceived and labels are easily read. The particular angles used to join side walls 74, 76 to rear wall 72 of channel 70 are not critical and may be varied in various embodiments to provide different angles of projection of the units of apparatus 10 relative to a wall on which the channel is mounted.

In an embodiment, each of the side walls 74, 76 are joined to the rear wall at an angle of approximately 60 degrees. Therefore, units of apparatus 10 of first set 78 and second set 79 are aligned at an angle θ of approximately 150 degrees. In other embodiments, other geometry may be used to achieve different values of the angle θ.

In an embodiment, the spaced apart pairs of holes in side wall 74 may be staggered or offset with respect to pairs of holes in side wall 76 for the purpose of providing clearance in an interior of the channel 70 for ends 52, 54 which may protrude into the channel. Consequently, units of the apparatus 10 in set 78 may appear staggered or offset with respect to corresponding units of the apparatus in set 79. In other embodiments, opposing sets of holes may be aligned so that units of the apparatus 10 in sets 78, 79 are directly opposite or aligned with one another.

Figure 19:
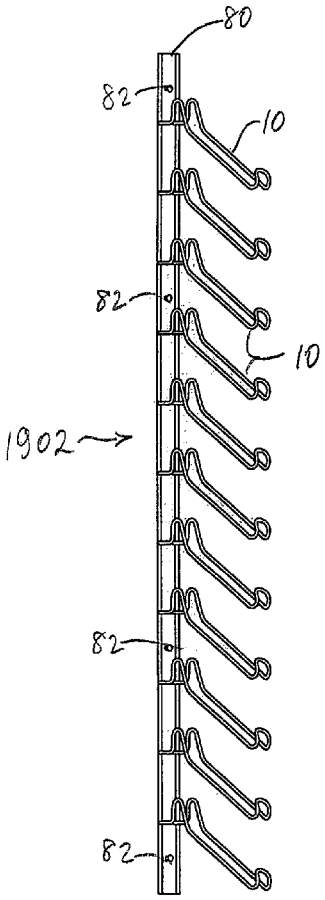
FIG. 19 is a perspective view of another example bottle rack.
Figure 20:
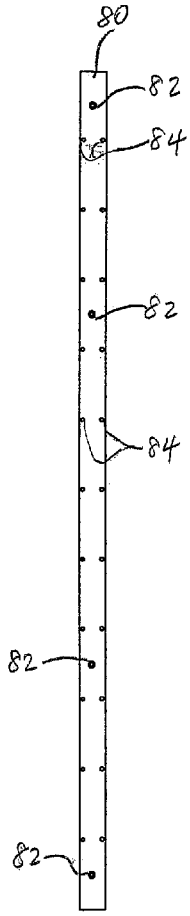
FIG. 20 is a front elevation view of a wall mounting channel.

FIG. 19 is a perspective view of another example bottle rack. FIG. 20 is a front elevation view of a wall mounting channel. Referring first to FIG. 19, in an embodiment, a bottle rack 1902 may comprise a plurality of units of apparatus 10 affixed to or mounted in an elongated, vertically aligned mounting channel 80. The units of apparatus 10 may be joined to or mounted in the channel 80 in positions that are spaced apart to permit clearance of bottles that are loaded onto the apparatus. Ends 52, 54 of units of apparatus 10 are snugly received in a plurality of spaced apart pairs of holes 84 in the channel 80, as best seen in FIG. 20. The channel 80 also may comprise a plurality of spaced apart mounting holes 82 for receiving fasteners such as screws or bolts to affix the channel to a stable unit or surface such as a wall, furnishing or other apparatus.

In various embodiments, any number of units of apparatus 10 may be used and the channels 70, 80 may have any elongated dimension. The particular dimensions and numbers of units of apparatus 10 shown in the drawing figures merely represent examples and other embodiments may vary to accommodate any number of one or more units of the apparatus. Channels 70, 80 may be fabricated from any suitably stable load bearing material. In one embodiment, channels 70, 80 comprise steel tubing or folded sheet steel. Bar stock, extruded parts, or other materials or forms may be used in various embodiments.

Extensions and Alternatives

The arrangements of any of FIG. 10, FIG. 11, FIG. 12, FIG. 13, FIG. 14, FIG. 15 could be used, for example, as a focal point, accent point or conversation point in a restaurant, and/or could be integrated into interior columns that serve as structural or aesthetic architectural features in the interior of a restaurant, home, or other premises.

Apparatus as described may be used to hold and/or display any of a variety of bottles. Examples include wine bottles, juice bottles, cider bottles, vinegar bottles, oil bottles, and bottles for any other kinds of beverages or fluids.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. Apparatus comprising an elongated element comprising a first end joined to a first arcuate neck retaining portion joined to a first arm joined to an arcuate loop comprising a curved end, a second arm parallel to the first arm and joining the arcuate loop to a second arcuate neck retaining portion that is aligned with the first arcuate neck retaining portion, and joined to a second end, wherein the first end is joined to the first arm at a downwardly extending angle, the second end is joined to the second arm at the downwardly extending angle, the arcuate loop is joined to the first arm and the second arm at an upwardly extending angle, and the first arcuate neck retaining portion and the second arcuate neck retaining portion are arched upwardly with respect to the first arm and the second arm.

2. The apparatus of claim 1 further comprising a first arc portion joining the first end to the first arcuate neck retaining portion and a second arc portion joining the second end to the second arcuate neck retaining portion.

3. The apparatus of claim 1 wherein the first arm is spaced apart from the second arm by less than a body width of a wine bottle.

4. The apparatus of claim 1 wherein the arcuate loop has a lateral width that is less than a punt of a wine bottle.

5. The apparatus of claim 1 wherein the elongated element is a rod having a round cross section.

6. The apparatus of claim 1 wherein the elongated element is a steel rod.

7. The apparatus of claim 1 wherein the elongated element has a length to enable a punt of a wine bottle to rest on the arcuate loop and a neck of the same bottle to rest between the first arcuate neck retaining portion and the second arcuate neck retaining portion when the same bottle is on the apparatus.

8. The apparatus of claim 7 wherein the wine bottle is a 750 ml wine bottle.

9. The apparatus of claim 1 wherein the elongated element comprises a contiguous rod in which all of the first end, the first arcuate neck retaining portion, the first arm, the arcuate loop, the second arm, the second arcuate neck retaining portion, and the second end are integrally formed.

10. A bottle rack apparatus comprising:

an upright support element comprising one or more pairs of holes;

one or more units of a bottle holder apparatus, wherein each of the units is mountable to a particular pair of the holes;

wherein each of the units of the bottle holder apparatus comprises an elongated element comprising a first end joined to a first arcuate neck retaining portion joined to a first arm joined to an arcuate loop comprising a curved end, a second arm parallel to the first arm and joining the arcuate loop to a second arcuate neck retaining portion that is aligned with the first arcuate neck retaining portion, and joined to a second end, wherein the first end is joined to the first arm at a downwardly extending angle, the second end is joined to the second arm at the downwardly extending angle, the arcuate loop is joined to the first arm and the second arm at an upwardly extending angle, and the first arcuate neck retaining portion and the second arcuate neck retaining portion are arched upwardly with respect to the first arm and the second arm.

11. The apparatus of claim 10 further comprising a first arc portion joining the first end to the first arcuate neck retaining portion and a second arc portion joining the second end to the second arcuate neck retaining portion.

12. The apparatus of claim 10 wherein the first arm is spaced apart from the second arm by less than a body width of a wine bottle.

13. The apparatus of claim 10 wherein the arcuate loop has a lateral width that is less than a punt of a wine bottle.

14. The apparatus of claim 10 wherein the elongated element is a rod having a round cross section.

15. The apparatus of claim 10 wherein the elongated element is a steel rod.

16. The apparatus of claim 10 wherein the elongated element has a length to enable a punt of a wine bottle to rest on the arcuate loop and a neck of the same bottle to rest between the first arcuate neck retaining portion and the second arcuate neck retaining portion when the same bottle is on the apparatus.

17. The apparatus of claim 16 wherein the wine bottle is a 750 ml wine bottle.

18. The apparatus of claim 10 wherein the elongated element comprises a contiguous rod in which all of the first end, the first arcuate neck retaining portion, the first arm, the arcuate loop, the second arm, the second arcuate neck retaining portion, and the second end are integrally formed.

19. The apparatus of claim 10 wherein the support element comprises any one of a post, a column, a bar, a channel, a standard, a tube, a panel and a wall.

20. The apparatus of claim 10, comprising a plurality of first rows of first units of the bottle holder apparatus and a plurality of second rows of second units of the bottle holder apparatus, wherein the first units are in a staggered alignment with respect to the second units.

21. The apparatus of claim 10, comprising a plurality of first rows of first units of the bottle holder apparatus and a plurality of second rows of second units of the bottle holder apparatus, wherein the first units are vertically aligned with the second units.

22. The apparatus of claim 10 wherein the support element is vertically elongated.

23. The apparatus of claim 10 wherein the support element comprises a wall joined at an acute angle to a floor.

24. The apparatus of claim 10 wherein the support element comprises a vertical post having a plurality of first style faces and a plurality of second style faces, and wherein the first style faces comprise a first plurality of pairs of holes that is different in number than a second plurality of pairs of holes in the second style faces.

25. The apparatus of claim 10 wherein the support element comprises a vertical post having a plurality of first style faces and a plurality of second style faces, and wherein the first style faces comprise a first plurality of units of the bottle holder apparatus that is different in number than a second plurality of units of the bottle holder apparatus in the second style faces.

26. The apparatus of claim 10 wherein the support element comprises a vertical post having a round cross section, a plurality of first style faces, and a plurality of second style faces, and wherein the first style faces comprise a first plurality of units of the bottle holder apparatus that is different in number than a second plurality of units of the bottle holder apparatus in the second style faces.

27. The apparatus of claim 10 wherein the support element comprises a standard having one or more spaced-apart pairs of holes, wherein each pair of holes may receive the first end and second end of one of the units of the bottle holder apparatus.

28. The apparatus of claim 10 wherein the support element has a triangular cross section and comprises a first wall and a second wall joined to or integrally formed with a rear wall, wherein each of the first wall and the second wall comprises a plurality of spaced apart mounting holes adapted to snugly receive a set of the units of the bottle holder apparatus.

29. The apparatus of claim 28 wherein the mounting holes of the first wall are aligned other than directly opposite to the mounting holes of the second wall.

30. The apparatus of claim 29 wherein each of the first wall and the second wall is joined to the rear wall at an angle of approximately 60 degrees.

* * * * *